US011375788B2

(12) United States Patent
Shim et al.

(10) Patent No.: US 11,375,788 B2
(45) Date of Patent: Jul. 5, 2022

(54) LUGGAGE WITH SUPPORT

(71) Applicant: JOURNEY JOURNAL PTE. LTD., Singapore (SG)

(72) Inventors: Hyunsuk Shim, Seoul (KR); Meiqi Beatrice Wee, Singapore (SG)

(73) Assignee: JOURNEY JOURNAL PTE. LTD., Singapore (SG)

( * ) Notice: Subject to any disclaimer, the term of this patent is extended or adjusted under 35 U.S.C. 154(b) by 0 days.

(21) Appl. No.: 17/417,269

(22) PCT Filed: Dec. 30, 2019

(86) PCT No.: PCT/KR2019/018692
§ 371 (c)(1),
(2) Date: Jun. 22, 2021

(87) PCT Pub. No.: WO2020/197053
PCT Pub. Date: Oct. 1, 2020

(65) Prior Publication Data

US 2022/0039529 A1 Feb. 10, 2022

(30) Foreign Application Priority Data

Mar. 26, 2019 (KR) ..... 10-2019-0034091

(51) Int. Cl.
*A45C 13/04* (2006.01)
*A45C 5/03* (2006.01)
(Continued)

(52) U.S. Cl.
CPC ..... *A45C 13/04* (2013.01); *A45C 5/03* (2013.01); *A45C 5/14* (2013.01); *A45C 13/001* (2013.01);
(Continued)

(58) Field of Classification Search
CPC .. A45C 5/03; A45C 5/14; A45C 13/04; A45C 13/005; A45C 13/262; A45C 2013/267
(Continued)

(56) References Cited

U.S. PATENT DOCUMENTS 1,081,221 A * 12/1913 Durkin ..... B65D 7/26 280/641
1,606,368 A * 11/1926 Horton ..... A45C 13/03 190/13 R
(Continued)

FOREIGN PATENT DOCUMENTS

CN 2794277 Y 7/2006
JP 3152227 U 7/2009
(Continued)

OTHER PUBLICATIONS

International Search Report for International Application No. PCT/KR2019/018692 dated Apr. 13, 2020.
(Continued)

*Primary Examiner* — Sue A Weaver
(74) *Attorney, Agent, or Firm* — JCIP; Joseph G. Chu; Jeremy I. Maynard

(57) ABSTRACT

The present invention relates to a luggage with a support. The luggage with the support according to an embodiment of the present invention includes: a main body unit having a storage space therein; a cover unit closing the storage space of the main body unit; and a frame unit provided on a rear surface of the main body unit to form a support supporting the main body unit. Here, the frame unit includes: a first frame having one side fixed to a lower portion of the main body unit and the other side that is rotatable; and a second frame moving along the rotation of the first frame and forming the support with the first frame.

15 Claims, 9 Drawing Sheets

(51) Int. Cl.
*A45C 5/14* (2006.01)
*A45C 13/00* (2006.01)
*A45C 13/26* (2006.01)

(52) U.S. Cl.
CPC ..... *A45C 13/005* (2013.01); *A45C 13/262* (2013.01); *A45C 2013/267* (2013.01)

(58) Field of Classification Search
USPC ..... 190/18 R
See application file for complete search history.

(56) References Cited

U.S. PATENT DOCUMENTS 5,129,491 A * 7/1992 Seidman ..... A45C 13/03 190/13 R
6,302,250 B1 * 10/2001 Sadow ..... A45C 5/14 190/115
7,226,073 B1 * 6/2007 Zahiri ..... A45C 5/14 190/115
8,333,271 B2 * 12/2012 Gibson ..... A45C 9/00 190/18 R
2010/0263977 A1 * 10/2010 Wu ..... A45C 5/14 190/18 A
2012/0103740 A1 * 5/2012 Moussatche ..... A45C 13/262 190/115
2019/0281942 A1 * 9/2019 Tong ..... A45C 13/02

FOREIGN PATENT DOCUMENTS

KR 2020000019292 U 11/2000
KR 1020190030823 A 3/2019
KR 102026155 B1 9/2019
WO 2017042507 A1 3/2017

OTHER PUBLICATIONS

Written Opinion of International Searching Authority for International Application No. PCT/KR2019/018692 dated Apr. 13, 2020.

* cited by examiner

LUGGAGE WITH SUPPORT

TECHNICAL FIELD

The present invention herein relates to a luggage with a support.

BACKGROUND

In general, a luggage is mainly used when a user travels to foreign countries or goes for a long stay travel. The luggage includes a storage space for storing articles therein, a handle disposed at an upper side thereof, and a wheel disposed at a bottom surface thereof and being in rolling contact with the ground, so that the user may hold the handle to pull the luggage without lifting the luggage.

Since the luggage may further easily carry a heavy load during a movement as the luggage is configured to have the above-described structure, the luggage has been used without considerable inconvenience.

However, the typical luggage has an inconvenient aspect in that when organizing or taking out articles in the luggage, the user has to bent oneself or squat down while the luggage is laid down on the ground, or put the luggage on a desk or a bed. Some hotels, to relieve the above-described inconvenience, separately prepare a luggage support having a height similar to a user's thigh height so that the luggage is able to be disposed thereon. However, the separate support may have a place restriction in that the support may be used at only the place where the support is prepared, and also have a limitation in that the luggage may not be supported when the luggage has a size much greater than that of the support. Also, since the user is required to lift and place the luggage on the support, it is a disadvantage that the user devotes one's efforts to put the heavy luggage on the support.

DETAILED EXPLANATION OF THE INVENTION

Technical Problem

The present invention provides a luggage that forms a support by itself without requiring a separate support.

The present invention also provides a luggage capable of forming a structure in which the luggage is further easily disposed on the support when the support provided in the luggage is formed.

The objectives of the present invention are not limited to the aforementioned object, but other objectives not described herein will be clearly understood by those skilled in the art from descriptions below.

Solution to the Problem

An embodiment of the present invention provides a luggage with a support, the luggage including: a main body unit having a storage space therein; a cover unit configured to close the storage space of the main body unit; and a frame unit provided on a rear surface of the main body unit to form a support configured to support the main body unit. Here, the frame unit includes: a first frame having one side fixed to a lower portion of the main body unit and the other side that is rotatable; and a second frame configured to move along the rotation of the first frame and form the support with the first frame.

In an embodiment, the second frame may have one side fixed to an upper portion of the main body unit and the other side rotating along the rotation of the first frame.

In an embodiment, the first frame or the second frame may further include: a connection part configured to connect the first frame and the second frame; and a guide line configured to guide a movement of the connection part.

In an embodiment, the first frame may further include a fixing part configured to fix positions of the first frame and the second frame, and the second frame may further include a fixing groove which is provided at a lower end side of the guide line and to which the fixing part is inserted. Here, the fixing part may be inserted to and separated from the fixing groove.

In an embodiment, the luggage may further include a control part configured to control the insertion and separation of the fixing part with respect to the fixing groove.

In an embodiment, the first frame may include: an outer frame provided at each of both left and right sides of the rear surface of the main body unit; and an inner frame inserted to an upper end of the outer frame to vertically move, and configured to connect the outer frames.

In an embodiment, the first frame may include: an inner frame provided at each of both left and right sides of the rear surface of the main body unit; and an outer frame into which the inner frame can be inserted. And the outer frame may be movable vertically having the inner frame inside the outer frame.

In an embodiment, the main body unit may further include a locking part provided at an upper portion of the main body unit to prevent the frame unit from being separated from the main body unit, and the first frame further include a locking groove to which the locking part is inserted. Here, the locking part may be inserted to and separated from the locking groove.

In an embodiment, the luggage may further include a locking control part configured to control the insertion and separation of the locking part with respect to the locking groove.

In an embodiment, the cover unit may include a first cover and a second cover, which are opened in opposite directions to each other.

In an embodiment, each of the first cover and the second cover may have a rectangular parallelepiped shape in which one side surface facing the main body unit is opened.

In an embodiment, each of the first cover and the second cover may have a detachable surface at which the first cover and the second cover contact each other.

In an embodiment, the second frame may further include an auxiliary frame provided at one side of the second frame to extend the second frame.

In an embodiment, the auxiliary frame may be connected to one end of the second frame through a hinge, and move along a rail provided on the rear surface of the main body unit.

In an embodiment, the auxiliary frame may be inserted into the second frame in a movable manner.

In an embodiment, the second frame may have one side that is movable along a rail part provided at an upper portion of the main body unit.

In an embodiment, the second frame may further include a coupling part disposed at one side thereof, and inserted to and separated from the main body unit, and the main body unit may further include a coupling groove which is disposed at each of upper and lower ends of the rail part and to which the coupling part is inserted.

In an embodiment, the main body unit may further include a coupling part disposed at each of the upper and lower ends of the rail part, and inserted to and separated from the second frame, and the second frame may further include a coupling groove which is defined at one side of the second frame and to which the coupling part is inserted.

In an embodiment, the main body unit may further include a frame accommodation groove defined at the rear surface of the main body unit to accommodate the frame unit.

Advantageous Effects

The luggage according to an embodiment of the present invention may form the support capable of supporting the luggage.

Also, the luggage according to an embodiment of the present invention may form the structure of disposing the luggage on the support with a less force based on the principle of the lever.

The objectives of the present invention are not limited to the aforesaid, but other objectives not described herein will be clearly understood by those skilled in the art from descriptions below.

DETAILED DESCRIPTION

Figure 1:
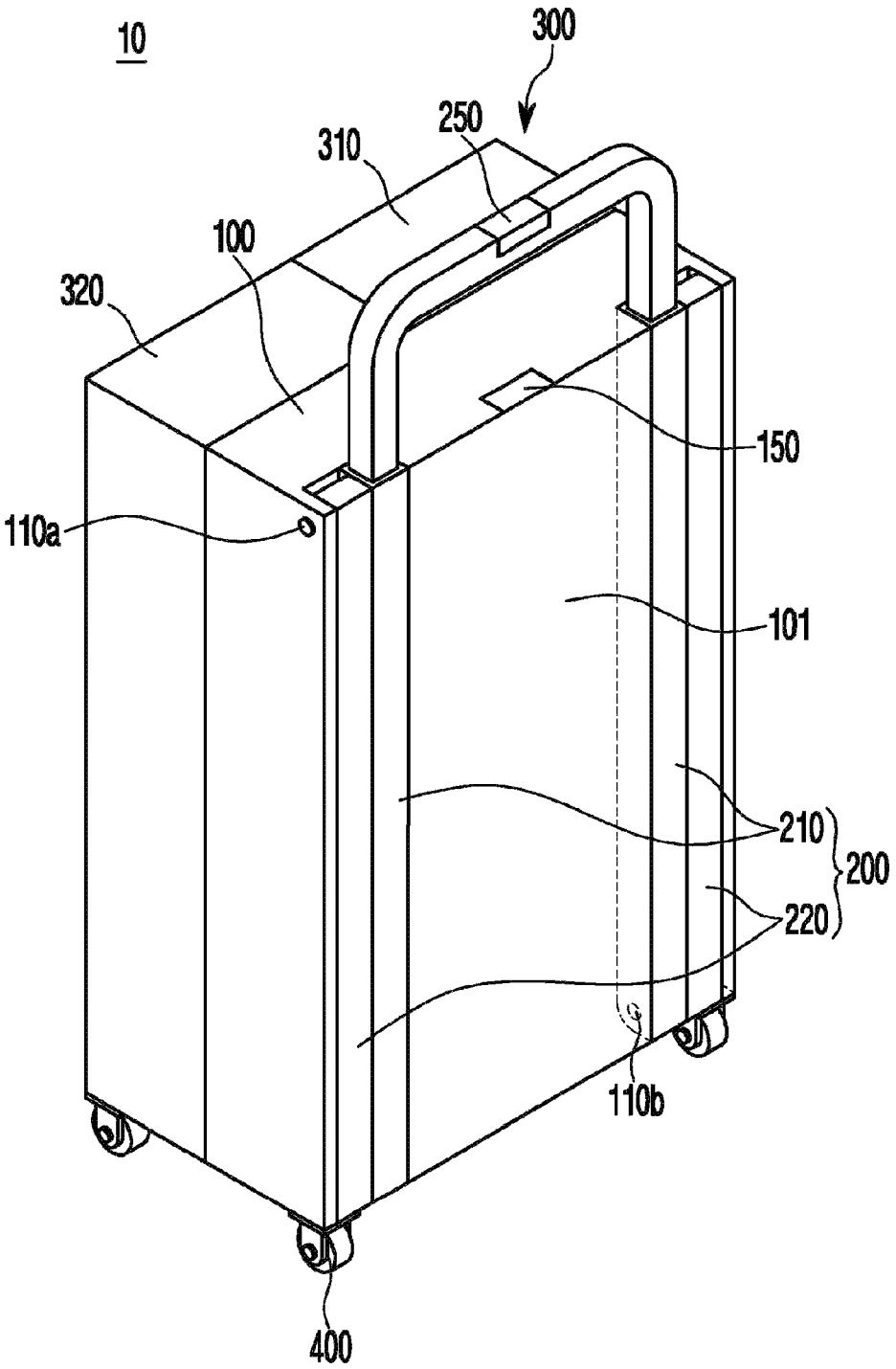
FIG. 1 is a perspective view illustrating a luggage according to an embodiment of the present invention.

In the following description, the technical terms are used only for explaining a specific exemplary embodiment while not limiting the present disclosure.

The terms of a singular form may include plural forms unless referred to the contrary. The meaning of 'comprises' and/or 'comprising' does not exclude other components besides a mentioned component. Like reference numerals refer to like elements throughout, and the word 'and/or' means that one or more or a combination of relevant constituent elements is possible. It will be understood that although the terms of first and second are used herein to describe various elements, these elements should not be limited by these terms. These terms are only used to distinguish one component from another component. Thus, as long as they are within the technical scope of the present invention, a first element could be termed a second element, and similarly a second element could be termed a first element. Furthermore, when it is described that one comprises (or includes or has) some elements, it should be understood that it may comprise (or include or has) only those elements, or it may comprise (or include or have) other elements as well as those elements if there is no specific limitation.

Hereinafter, exemplary embodiments of the present invention will be explained in detail with reference to the accompanying drawings.

FIG. 1 is a perspective view illustrating a luggage according to an embodiment of the present invention.

As illustrated in FIG. 1, a luggage 10 according to an embodiment of the present invention may include a main body unit 100, a frame unit 200, a cover unit 300, and a moving wheel 400.

The main body unit 100 has a storage space defined therein and includes a frame accommodation groove 110 defined at each of both sides of a rear surface 101 of the main body unit 100 to accommodate the frame unit 200. As the frame accommodation groove 110 is defined in the main body unit 100 to accommodate the frame unit 200, the luggage may maintain a flat rear surface when the support is not formed.

The frame unit 200 is provided at the rear surface 101 of the main body unit 100 to form a support that supports the main body unit 100. The frame unit 200 may include a first frame 210 and a second frame 220, which form an X-shape when the support is formed. The first frame 210 may have one side fixed to a lower portion of the main body unit 100 and the other side that is rotatable. For example, the one side of the first frame 210, which is fixed to the lower portion of the main body unit 100, may be fixed by being coupled to a hinge shaft 110*b* provided at the lower portion of the main body unit 100. The second frame 220 may move along the rotation of the first frame 210 so as to form the support with the first frame 210. In an embodiment, the second frame 220 may have one side fixed to an upper portion of the main body unit 100 and the other side that is rotatable. For example, the one side of the second frame 220, which is fixed to the upper portion of the main body unit 100, may be fixed by being coupled to a hinge shaft 110*a* provided at the upper portion of the main body unit 100. Also, the second frame 220 may rotate along the rotation of the first frame 210. For example, the second frame 220 may rotate at the same or similar distance and angle as a movement distance and a movement angle of the first frame 210.

The first frame 210 or the second frame 220 of the frame unit 200 may include a connection part 211 connecting the first frame 210 and the second frame 220 and a guide line 221 guiding a movement of the connection part 211. For example, when the connection part 211 is provided to one of the first frame 210 or the second frame 220, the guide line 221 may be provided to the frame not including the connection part 211. Also, the first frame 210 or the second frame 220 of the frame unit 200 may further include a fixing part 213 fixing positions of the first frame 210 and the second frame 220 and a fixing groove 223 to which the fixing part 213 is inserted. For example, when the fixing part 213 is provided to one of the first frame 210 and the second frame 220, the fixing groove 223 may be provided to the frame not including the fixing part 213.

The cover unit 300 may close the storage space of the main body unit 100. The cover unit 300 may include a first cover 310 and a second cover 320. The first cover 310 and the second cover 320 may have the same area or similar areas and be opened in opposite directions to each other. In an embodiment, the first cover 310 may be opened in a left direction, and the second cover 320 may be opened in a right direction. However, the embodiment of the present invention is not limited thereto. For example, the first cover 310 and the second cover 320 having the same area as each other may be disposed at upper and lower portions and opened to upper and lower sides, respectively. As the first cover 310 and the second cover 320 have the structures having the same area or similar areas and opened in opposite directions to each other as described above, when the frame unit 200 forms the support to support the main body unit, a center of gravity may be prevented from being biased.

The moving wheel 400 may be provided on a bottom surface of the luggage 10. In an embodiment, the moving wheel 400 disposed at a rear surface side of the luggage 10 may be disposed at a lower end of the second frame 220. Thus, when the frame unit 200 forms the support, the lower end of the second frame 220 may slide through the moving wheel 400 to further easily form the support.

Figure 2:
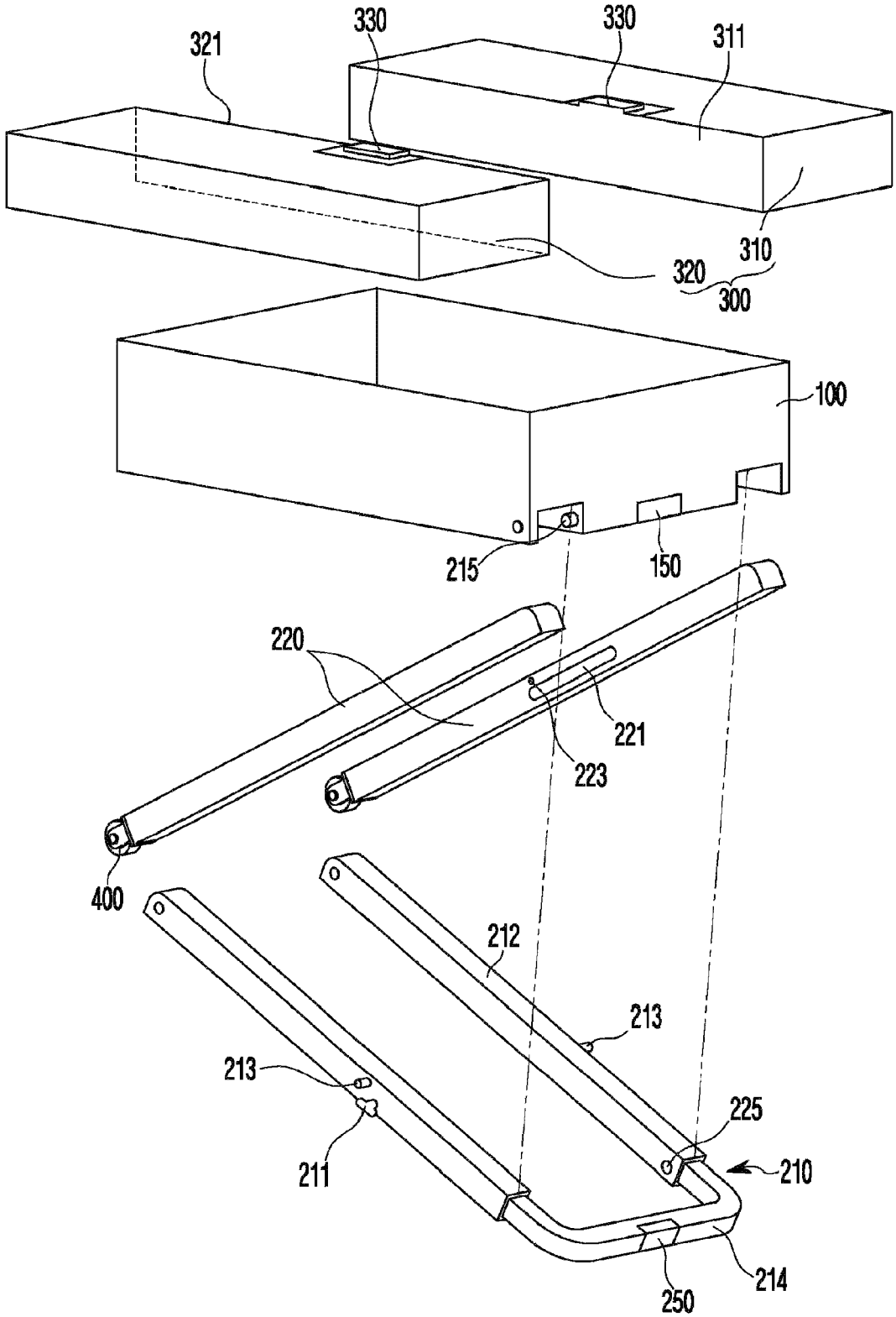
FIG. 2 is an exploded perspective view illustrating the luggage with a support according to an embodiment of the present invention.

FIG. 2 is an exploded perspective view illustrating the luggage with the support according to an embodiment of the present invention.

The frame unit 200 according to an embodiment of the present invention may form the support as the first frame 210 and the second frame 220 form an X-shape. The above-described configuration of the first frame 210 and the second frame 220 to form the support will be described in detail with reference to FIG. 2. Although FIG. 2 illustrates, as an embodiment of the present invention, a structure including the first frame 210 including the connection part 211 and the fixing part 213 and the second frame 220 including the guide line 221 and the fixing groove 223, alternatively, the first frame 210 may include the guide line 221 and the fixing groove 223, and the second frame 220 may include the connection part 211 and the fixing part 213. The first frame 210 may include the connection part 211, the fixing part 213, a locking groove 225, and a control part 250. The second frame 220 may include the guide line 221 and the fixing groove 223.

The connection part 211, as a member connecting the first frame 210 and the second frame 220, may be fixed to an intermediate area of the first frame 210. In an embodiment, the connection part 211 may have an end inserted to the guide line 221 of the second frame 220, and the end may have a diameter greater than a width of the guide line 221 in order to prevent the second frame 220 from being separated from the first frame 210.

The guide line 221 is disposed at an inner surface of the second frame 220, which faces the first frame 210, to guide a movement of the connection part 211. The guide line 221 may be provided as a groove having a predetermined length so that the connection part 211 is movable therein.

The fixing part 213 is provided at a position adjacent to the connection part 211 and inserted to the fixing groove 223 to fix positions of the first frame 210 and the second frame 220 in a state of forming the support having the X-shape. As the fixing part 213 fixes the positions of the first frame 210 and the second frame 220, a situation, in which the support is folded such that the first frame 210 moves along the guide line 221 of the second frame 220 in a reverse direction when the main body unit 100 of the luggage 10 is disposed on the support, may be prevented. The fixing part 213 has a shape capable of being inserted into or separated from the fixing groove 223 of the second frame 220. In an embodiment, although the fixing part 213 may have a shape capable of being inserted into or separated from the fixing groove 223 as a spring is connected to one end of the fixing part 213, the embodiment of the present invention is not limited thereto.

The fixing groove 223 is provided at a lower end side of the guide line 221 with respect to the second frame 220. Thus, when the connection part 211 of the first frame 210 is disposed at a lower end of the guide line 221 of the second frame 220, the fixing groove 223 may accommodate the fixing part 213 to fix the positions of the first frame 210 and the second frame 220.

The locking groove 225 may be defined at the upper portion of the first frame 210 to accommodate the locking part 215 of the main body unit 100. The locking part 215 of the main body unit 100 may have a shape capable of being inserted to and separated from the locking groove 225. In an embodiment, although the locking part 215 may have a shape capable of being inserted into and separated from the locking groove 225 as a spring is connected to one end of the locking part 215 like the fixing part 213, the embodiment of the present invention is not limited thereto. In case of the luggage not forming the support, the locking part 215 may be inserted to the locking groove 225 to prevent the frame unit 200 from being separated from the main body unit 100.

The insertion and separation of the fixing part 213 with respect to the fixing groove 223 may be controlled by the control part 250. Also, the insertion and separation of the locking part 215 with respect to the locking groove 225 may be controlled by the locking control part 150. For example, the control part 250 may be provided as a button type. Here, when the button is pushed, the fixing part 213 may be separated from the fixing groove 223 and then move into the first frame 210. The locking control part 150 may be also provided as a button type. Thus, when the button is pushed, the locking part 215 may be separated from the locking groove 225 and then move into the main body unit. The controlling of the fixing part 213 and the locking part 215 by the control part 250 and the locking control part 150 respectively will be described later in more detail with reference to FIGS. 5 and 6.

In an embodiment, the first frame 210 may include an outer frame 212 provided at each of both left and right sides of the rear surface of the main body unit 100 and an inner frame 214 inserted into the upper end of the outer frame 212 to vertically move and connecting the outer frame. In an embodiment, the vertical movement of the inner frame 214 may be controlled by a projection (not shown) provided to the inner frame 214 which is inserted into and separated from a projection accommodation groove (not shown) defined at an inner surface of the outer frame 212. In this case, the insertion and separation of the projection (not shown) may be controlled by the control part 250 controlling the movement of the fixing part 213.

In another embodiment, relationship between the outer frame 212 and the inner frame 214 may be formed the other way, contrary to FIG. 2. That is, a part generally used as a handle may be formed by the outer frame 212, and the part represented as the outer frame 212 in FIG. 2 may be formed as the inner frame 214. In detail, the inner frame 214 may be provided at each of both left and right sides of the rear surface of the main body unit 100, the outer frame 212 may be formed in a handle shape. The outer frame 212 may be formed to be vertically movable having the inner frame 214 inside the outer frame 212.

The cover unit 300 according to an embodiment of the present invention may include a first cover 310 and a second cover 320, which have the same area or similar areas. Each of the first cover 310 and the second cover 320 may have a rectangular parallelepiped shape in which one side surface facing the main body unit 100 is opened. Thus, a load may be separately accommodated in the first cover 310 and the second cover 320 in addition to the main body unit 100 to exhibit an effect of further easily organizing and taking out accommodated objects. In an embodiment, a detachable closing part may be further provided on the opened one side surface of each of the first cover 310 and the second cover 320 to prevent the accommodated objects from falling out of the first cover 310 and the second cover 320. Also, surfaces 311 and 321 at which the first cover 310 and the second cover 320 contact each other, may be provided as a detachable type. For example, although the contact surfaces 311 and 321 may be provided as a non-woven fabric type that is attachable to and detachable from any inner side surfaces of the first cover 310 and the second cover 320, the embodiment of the present invention is not limited thereto. As described above, as the contact surfaces 311 and 321 of the first cover 310 and the second cover 320 are detachably provided, when a high volume object is accommodated in the main body unit 100, the contact surfaces 311 and 321 of the first cover 310 and the second cover 320 may be separated to secure a sufficient space for the high volume object. A cover locking part 330 may be provided at each of front central portions of the first cover 310 and the second cover 320 so that the cover locking parts are coupled to each other. For example, although the cover locking part 330 may be provided as a buckle type that couples the first cover 310 and the second cover 320, the embodiment of the present invention is not limited thereto.

Figure 3:
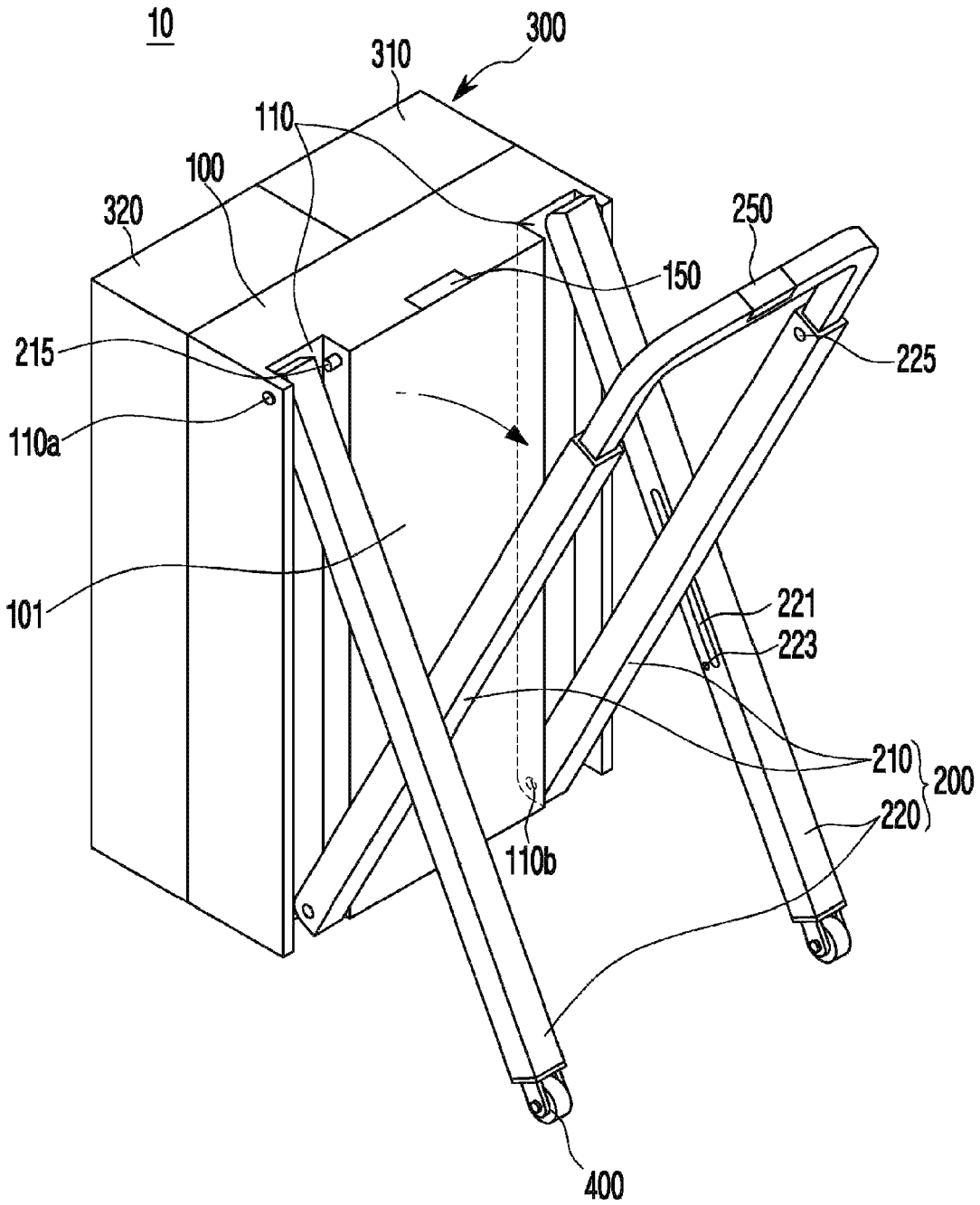
FIG. 3 is a view illustrating a process of forming the support of the luggage according to an embodiment of the present invention.
Figure 4:
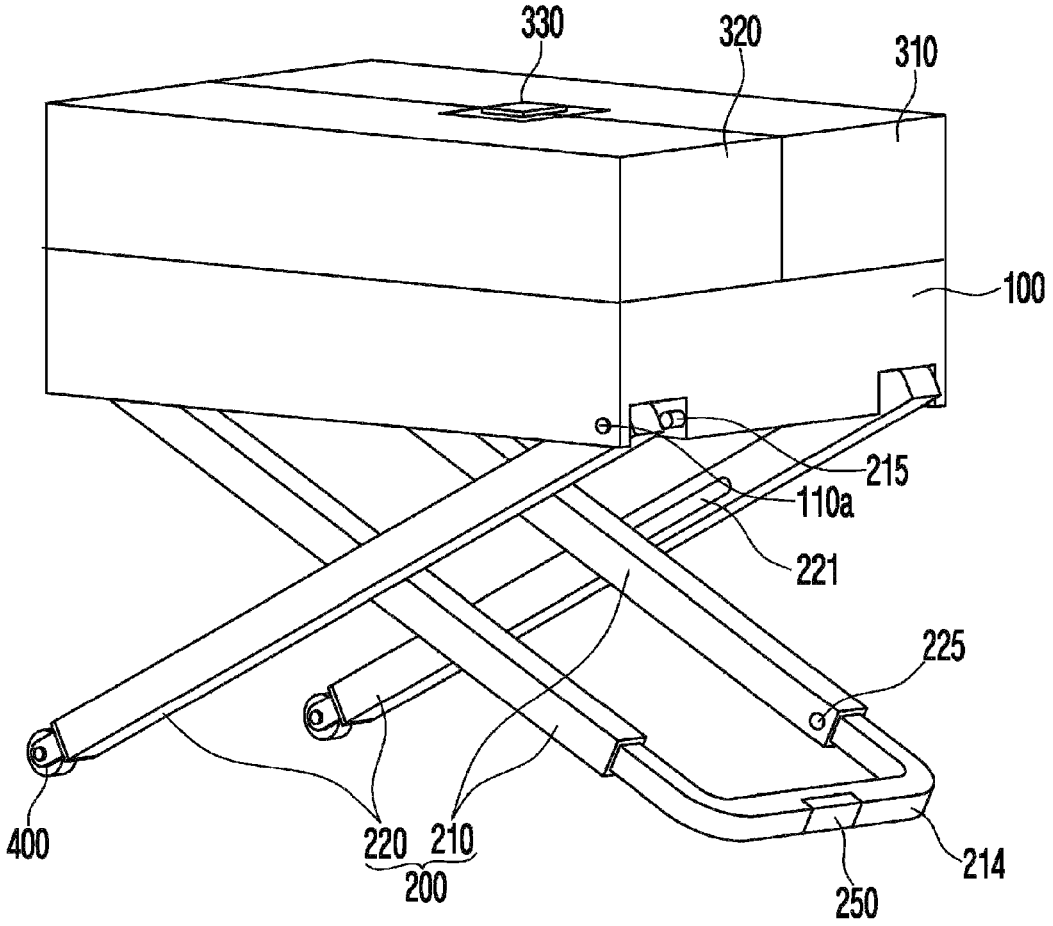
FIG. 4 is a usage state view illustrating the luggage with the support according to an embodiment of the present invention.

FIG. 3 is a view illustrating a process of forming the support of the luggage according to an embodiment of the present invention, and FIG. 4 is a usage state view illustrating the luggage with the support according to an embodiment of the present invention. The process of forming the support of the luggage will be sequentially described with reference to FIGS. 3 and 4.

Firstly, when a user intends to form the support of the luggage 10 according to an embodiment of the present invention, the user necessarily moves the upper portion of the first frame 210 apart from the main body unit 100 while pushing the locking control part 150. In this case, while the locking part 215 inserted into the locking groove 225 is separated from the locking groove 225 by the control operation of pushing the locking control part 150 by the user, the upper portion of the first frame 210 may rotate away from the main body unit 100. Thereafter, when the upper portion of the first frame 210 continuously rotates, as the connection part of the first frame 210 moves along the guide line 221 of the second frame 220, a lower portion of the second frame 220 rotates away from the main body unit 100. Thereafter, when the connection part of the first frame 210 is disposed at a lower end of the guide line 221 of the second frame 220 and does not move further, while the fixing part of the first frame 210 is inserted into the fixing groove 223 defined at a lower end side of the guide line 221, the support having an 'X'-shape formed by the first frame 210 and the second frame 220 is fixed. That is, the fixing part is blocked by the second frame 220 not to protrude from the first frame 210 when the connection part moves along the guide line 221, and protrudes and is inserted into the fixing groove 223 when the connection part is disposed at the lower end of the guide line 221. When the positions of the first frame 210 and the second frame 220 in a state in which the support is formed as described above are fixed, the user may hold and rotate an upper end of the first frame 210 so that the upper portion is disposed on the ground to form a structure in which the main body unit 100 of the luggage 10 is disposed on the support as illustrated in FIG. 4. In this case, since the structure in which the main body unit 100 of the luggage 10 is disposed on the support may be realized by the principle of the lever, the above-described structure may be realized by using a much less force in comparison with the related art that lifts and positions a luggage on a separate support.

Figure 5:
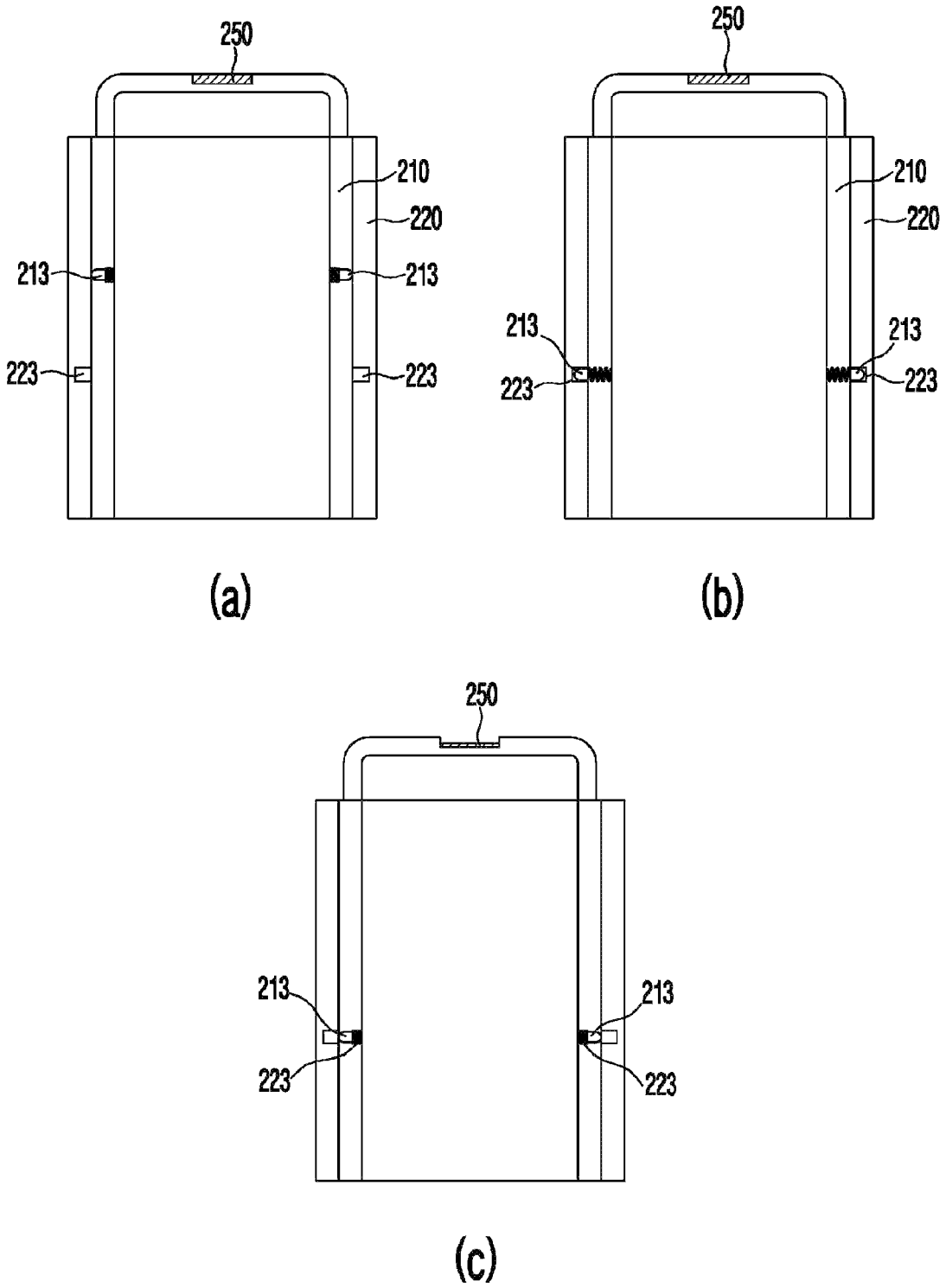
FIGS. 5*a*-5*c* are views for explaining a position of a fixing part according to an operation of a control part according to an embodiment of the present invention.

FIG. 5 is a view for explaining a position of the fixing part according to an operation of the control part according to an embodiment of the present invention. FIG. 5 is a view for explaining the position of the fixing part according to the operation of the control part and illustrated excluding a component that is not related to the position of the fixing part according to the operation of the control part. Also, although a spring is provided at one end of the fixing part 213 for left and right movements of the fixing part 213 in FIG. 5, the embodiment of the present invention is not limited thereto. For example, any structure capable of moving the fixing part 213 in left and right directions according to the operation of the control part 250 is acceptable.

Specifically, FIG. 5A is a view illustrating a position of the fixing part 213 when the support is not formed, FIG. 5B is a view illustrating a position of the fixing part 213 when the support is formed, and FIG. 5C is a view illustrating a position of the fixing part 213 when the control part operates to fold the support after the support is formed.

That is, the fixing part 213 is in a compressed state blocked by the second frame 220 when the support is not formed, as illustrated in FIG. 5A, and the fixing part 213 in the compressed state as in FIG. 5A moves toward the fixing groove 223 in a process of forming the support. When the support is completely formed, the fixing part 213 is positioned corresponding to the fixing groove 223 having a space to which the fixing part 213 is inserted as illustrated in FIG. 5B, and then automatically inserted into the fixing groove 223 to fix the X-shape formed by the first frame 210 and the second frame 220. When the first frame 210 and the second frame 220 are intended to be disposed at the rear surface of the main body unit by folding the support again, the control part 250 may operate to control the fixing part 213 to be separated from the fixing groove 223 as illustrated in FIG. 5C. In an embodiment, the control part 250 may have an arbitrary button shape, and while the spring provided at one end of the fixing part 213 is compressed by an operation of pushing the control part 250, the fixing part 213 may be taken out and separated from the fixing groove 223.

Figure 6:
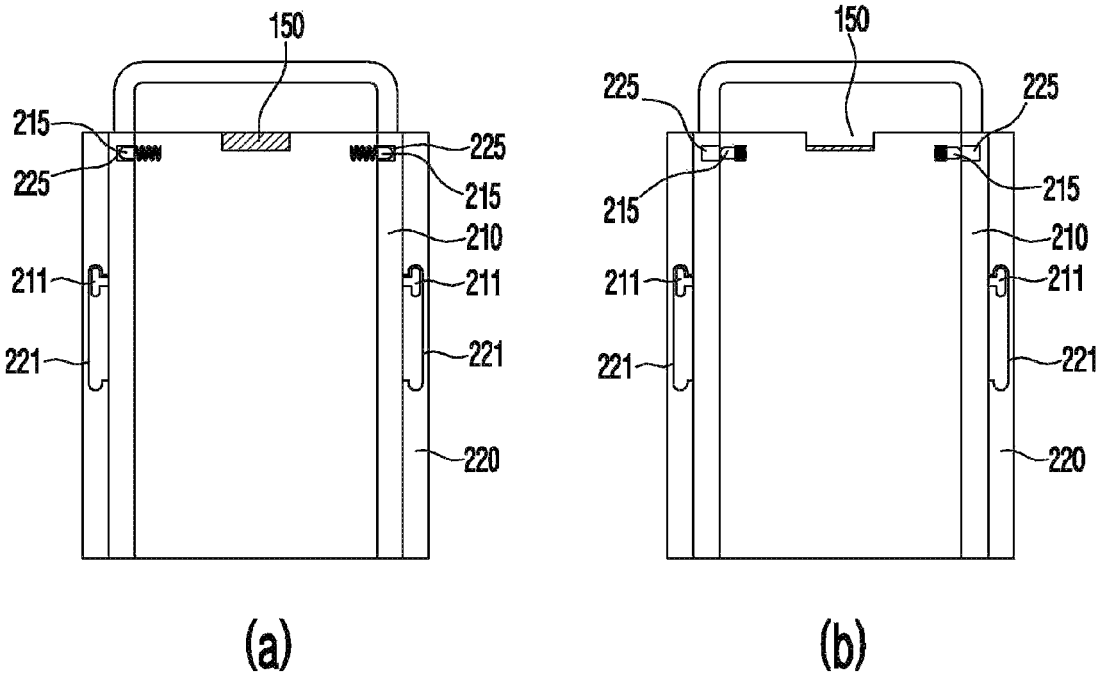
FIGS. 6*a*-6*b* are views for explaining a position of a locking part according to an operation of a locking control part according to an embodiment of the present invention.

FIG. 6 is a view for explaining a position of the locking part according to an operation of the locking control part 150 according to an embodiment of the present invention. Although a spring is provided at one end of the locking part 215 for left and right movements of the locking part 215 in FIG. 6, the embodiment of the present invention is not limited thereto. For example, any structure capable of moving the locking part 215 in left and right directions according to the operation of the locking control part 150 is acceptable.

Specifically, FIG. 6A is a view illustrating a position of the locking part 215 during a normal movement time, i.e., a state in which the first frame 210 and the second frame 220 are fixed to the rear surface of the main body unit, and FIG. 6B is a view illustrating a position of the locking part 215 in a state in which a locking state is released by operating the locking control part to form the support.

That is, in a normal movement time, as illustrated in FIG. 6A, the locking part 215 provided at an upper portion of the main body unit is inserted to the locking groove 225 of the first frame 210 and fixes the first frame 210 to the main body unit to prevent the frame unit from being separated from the main body unit. In case of forming the support, as illustrated in FIG. 6B, the locking control part 150 may operate to control the locking part 215 to be separated from the locking groove 225. In an embodiment, the locking control part 150 may have an arbitrary button shape, and while the spring provided at one end of the locking part 215 is compressed by an operation of pushing the locking control part 150 having the button shape, the locking part 215 may be taken out and separated from the locking groove. Thus, a locking state of the locking part 215 may be released, and the first frame 210 and the second frame 220 may rotate in opposite directions to be away from the main body unit.

Figure 7:
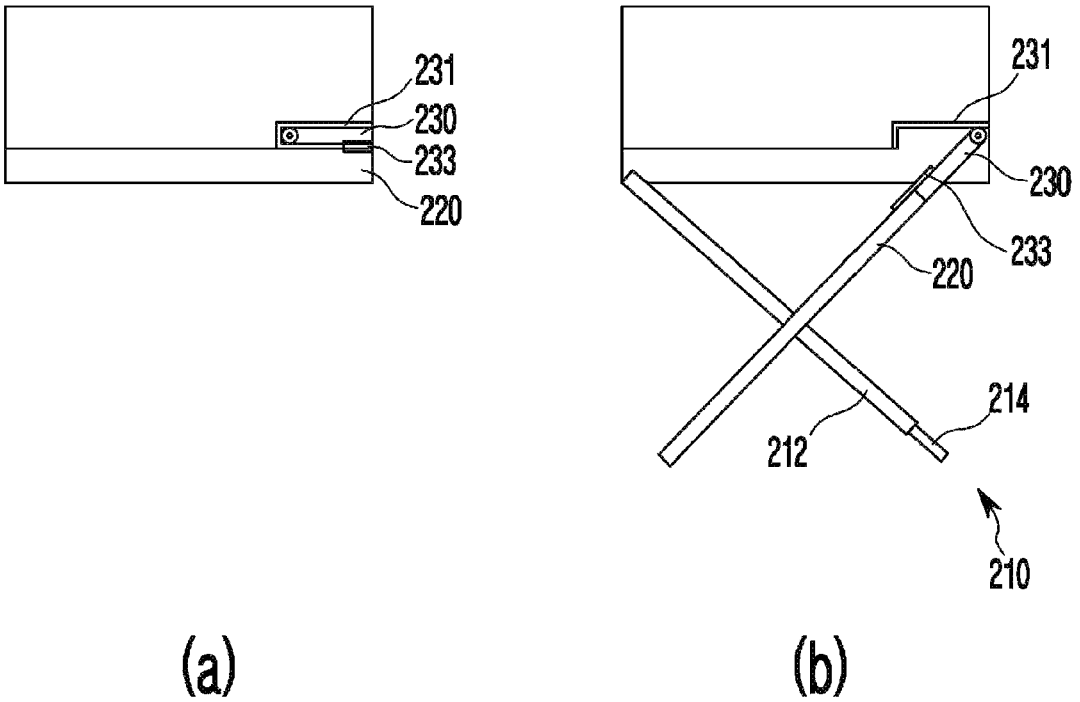
FIGS. 7*a*-7*b* and FIGS. 8*a*-8*b* are views for explaining a process of forming a support of a frame unit according to another embodiment of the present invention.
Figure 8:
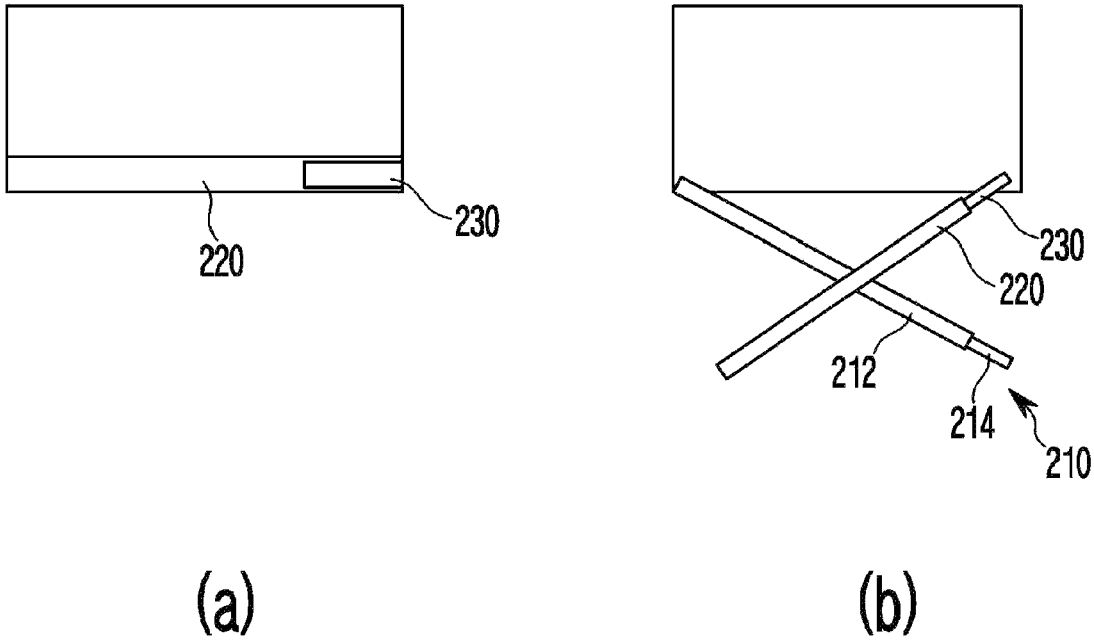

FIGS. 7 and 8 are views for explaining a process of forming a support of a frame unit according to another embodiment of the present invention. As illustrated in FIGS. 7 and 8, a second frame 220 of a frame unit according to another embodiment of the present invention may further include an auxiliary frame 230 provided at one side of the second frame 220 to extend the second frame 220. In this case, as described above in FIG. 2, as an inner frame 214 is inserted into an outer frame 212 to vertically move, a first frame 210 is adjustable in length. As described above, as the frame of the frame unit has an extendable length, the support may have a higher height even in case of a luggage having a small size and a short frame length.

FIG. 7 is a view illustrating a first embodiment of the extendable second frame 220, and FIG. 8 is a view illustrating a second embodiment of the extendable second frame 220. When the first frame 210 and the second frame 220 form the support in FIGS. 7 and 8, a fixing pin may be fixed to an area, in which the first frame 210 and the second frame 220 contact each other, so that the first frame 210 and the second frame 220 are connected. Thus, the first frame 210 and the second frame 220 may rotate around the fixing pin as an axis to form the support.

As illustrated in FIG. 7, the auxiliary frame 230 according to the first embodiment may be connected to one end of the second frame 220 through a hinge 233, and move along a rail 231 provided on a rear surface of the main body unit. FIG. 7A is a view illustrating a structure of the second frame 220 and the auxiliary frame 230 in case of not forming the support, and FIG. 7B is a view illustrating a structure of the second frame 220 and the auxiliary frame 230 in case of forming the support. In case of not forming the support, as illustrated in FIG. 7A, the second frame 220 and the auxiliary frame 230 in a state folded by the hinge are accommodated in an accommodation groove defined in the rear surface of the main body unit. In case of forming the support, as the auxiliary frame 230 moves along the rail 231, an angle between the auxiliary frame 230 and the second frame 220 may gradually increase, and, as the second frame 220 and the auxiliary frame 230 form a straight line as illustrated in FIG. 7B, the support including the frame having an extended length may be formed.

As illustrated in FIG. 8, an auxiliary frame 230 according to the second embodiment may be inserted into a second frame 220 in a movable manner FIG. 8A is a view illustrating a structure of the second frame 220 and the auxiliary frame 230 in case of not forming a support, and FIG. 8B is a view illustrating a structure of the second frame 220 and the auxiliary frame 230 in case of forming the support. In case of not forming the support, as illustrated in FIG. 8A, the auxiliary frame 230 may be inserted into the second frame 220. In case of forming the support, the auxiliary frame 230 may move to protrude from an upper end of the second frame 220, thereby forming the support including the frame having an extended length as illustrated in FIG. 8B. In this case, the auxiliary frame 230 may further include a projection (not shown) disposed at a lower end side of the auxiliary frame 230, and when the auxiliary frame 230 completely protrudes from the second frame 220 to form the extended frame, the projection (not shown) may protrude from the second frame 220 to prevent the auxiliary frame 230 from being unintentionally inserted into the second frame 220. Thus, a control part (not shown) for controlling a movement of the projection so that the projection (not shown) is inserted into the auxiliary frame 230 when the auxiliary frame 230 is intentionally inserted into the second frame 220 may be further provided.

Figure 9:
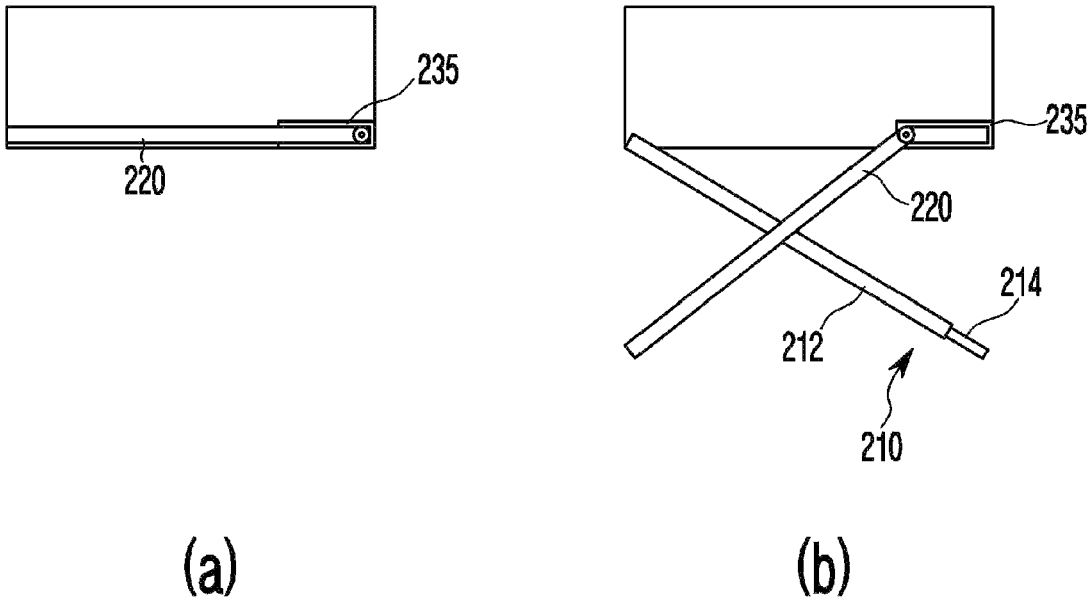
FIGS. 9*a*-9*b* are views for explaining a process of forming a support of a frame unit according to another embodiment of the present invention.

FIG. 9 is a view for explaining a process of forming a support of a frame unit according to another embodiment of the present invention.

As illustrated in FIG. 9, a second frame 220 may have one side moving along a rail part 235 provided at an upper portion of a main body unit. FIG. 9A is a view illustrating a position of the second frame 220 in case of not forming a support, and FIG. 9B is a view illustrating a position of the second frame 220 in case of forming the support. In this case, as one side of a first frame 210 rotates, one end of the second frame 220, which is coupled with the rail part 235, may move along the rail part 235 to form the support having an X-shape. Here, like the embodiments in FIGS. 7 and 8, when the first frame 210 and the second frame 220 form the support, a fixing pin may be fixed to an area, in which the first frame 210 and the second frame 220 contact each other, so that the first frame 210 and the second frame 220 are connected. When the support is formed as in FIG. 9, since the second frame 220 forms a height higher than that when the one end of the second frame 220 is fixed to an upper portion of a main body unit, the support may be formed with a higher height even without an auxiliary frame. In an embodiment, the second frame 220 may further include a coupling part, which is disposed at one side thereof and inserted to and separated from the main body unit, in order to fix a position of the second frame 220 in each cases of forming the support and not forming the support. In this case, the rail part 235 provided in the main body unit may further include a coupling groove which is defined at each of upper and lower ends thereof and to which the coupling part is inserted.

Figure 10:
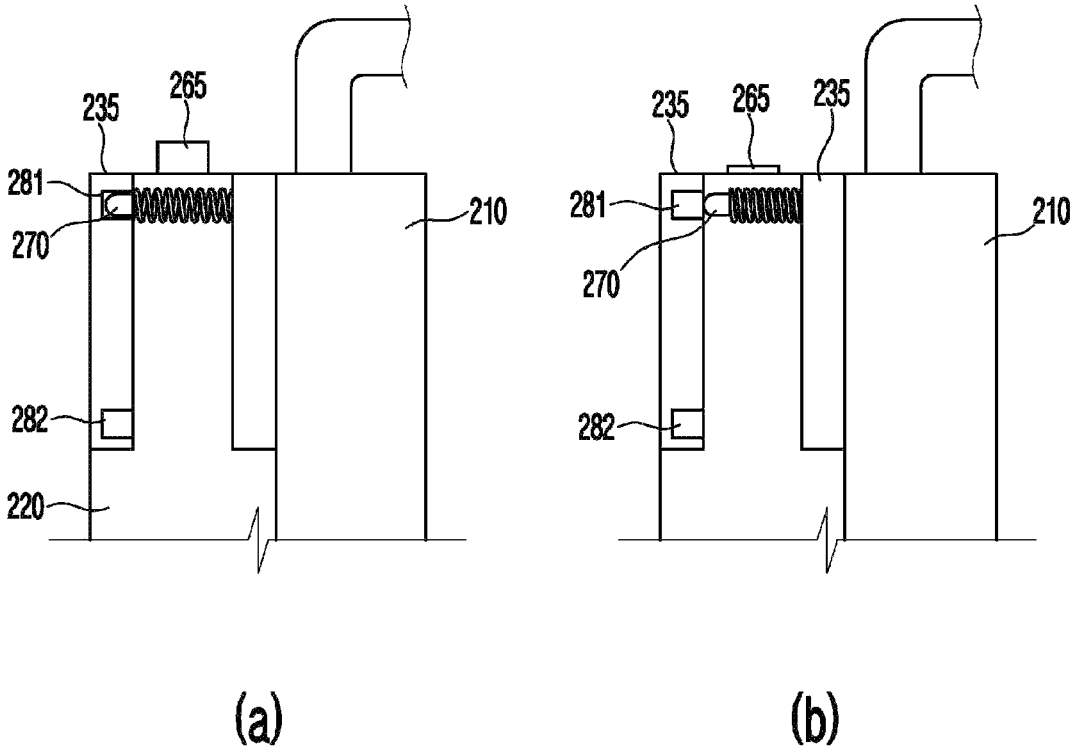
FIGS. 10*a*-10*b* are views for explaining an operation of a coupling part according to an operation of a coupling control part in the embodiment of FIG. 9.

FIG. 10 is a view for explaining an operation of a coupling part 270 according to an operation of a coupling control part 265 in the embodiment in FIG. 9. Although a spring is provided at one end of the coupling part 270 for left and right movements of the coupling part 270 in FIG. 10, the embodiment of the present invention is not limited thereto. For example, any structure capable of moving the coupling part 270 in left and right directions according to an operation of the coupling control part 265 is acceptable.

As illustrated in FIG. 10, the second frame 220 may further include the coupling part 270 disposed at an upper end of the second frame 220 and capable of being inserted to and separated from the main body unit, and the rail part 235 may further include coupling grooves 281 and 282 which are defined at the upper and lower portions of the rail part 235, respectively, and to which the coupling part 270 is inserted. The coupling part 270 may be inserted to the coupling groove 281 defined at the upper portion of the rail part 235 in case of not forming the support, and inserted to the coupling groove 282 defined at the lower portion of the rail part 235 in case of forming the support. A coupling control part 265 for controlling the coupling part 270 to be inserted to and separated from the coupling grooves 281 and 282 as described above may be provided at an upper end of the second frame 220. FIG. 10A is a view illustrating a position of the coupling part 270 in a state in which the coupling control part 265 does not operate, and FIG. 10B is a view illustrating a position of the coupling part 270 in a state in which the coupling control part 265 operates. That is, in case of forming the support, the user may operate the coupling control part 265 as in FIG. 10B to separate the coupling part 270 from the coupling groove 281 defined at the upper portion of the rail part 235. Also, when one end of the second frame 220 moves toward a lower end side of the rail part 235 to form the support, the coupling part 270 may be automatically inserted into the coupling groove 282 defined at the lower portion of the rail part 235 to fix a position of the support. Thereafter, in case of folding the support again, the user may operate the coupling control part 265 to separate the coupling part 270 from the coupling groove 282 defined at the lower portion of the rail part 235.

Figure 11:
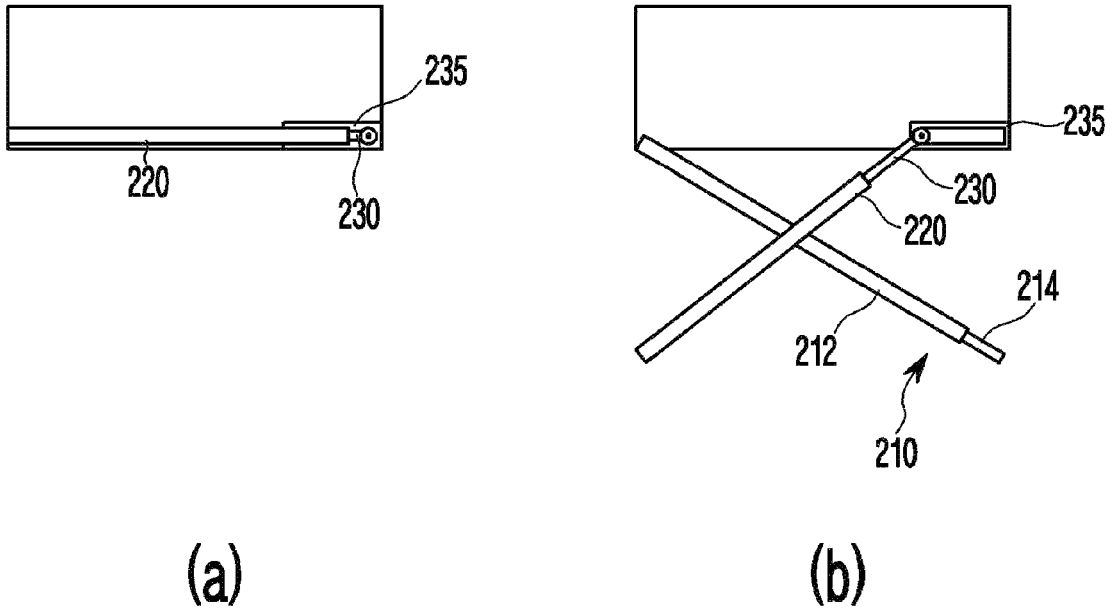
FIGS. 11*a*-11*b* are views for explaining a process of forming a support of a frame unit according to another embodiment of the present invention.

FIG. 11 is a view for explaining a process of forming a support of a frame unit according to another embodiment of the present invention.

As illustrated in FIG. 11, a second frame 220 may have one side moving along a rail part 235 provided at an upper portion of a main body unit. FIG. 11A is a view illustrating a position of the second frame 220 in case of not forming a support, and FIG. 11B is a view illustrating a position of the second frame 220 in case of forming the support. Also, an auxiliary frame 230 may be provided to the second frame 220 and inserted into the second frame 220 in a movable manner.

As one side of a first frame 210 rotates, one end of the second frame 220, which is coupled to a rail part 235, may move along the rail part 235, and then the auxiliary frame 230 inserted into the second frame 220 may protrude therefrom. Thus, the first frame 210 and the second frame 220 may form the support having an X-shape.

As illustrated in FIG. 11, since the second frame 220 forms a height higher than that when a structure of the rail part 235 or a structure of the auxiliary frame 230 is singly used by using the structures of the rail part 235 and the auxiliary frame together, there is an advantage in that the support has a higher height. Even in this case, as described through FIG. 9, the second frame 220 may further include a coupling part, which is disposed at one side thereof and inserted to and separated from the main body unit, and the rail part 235 provided in the main body unit may further include a coupling groove to which the coupling part is inserted.

Figure 12:
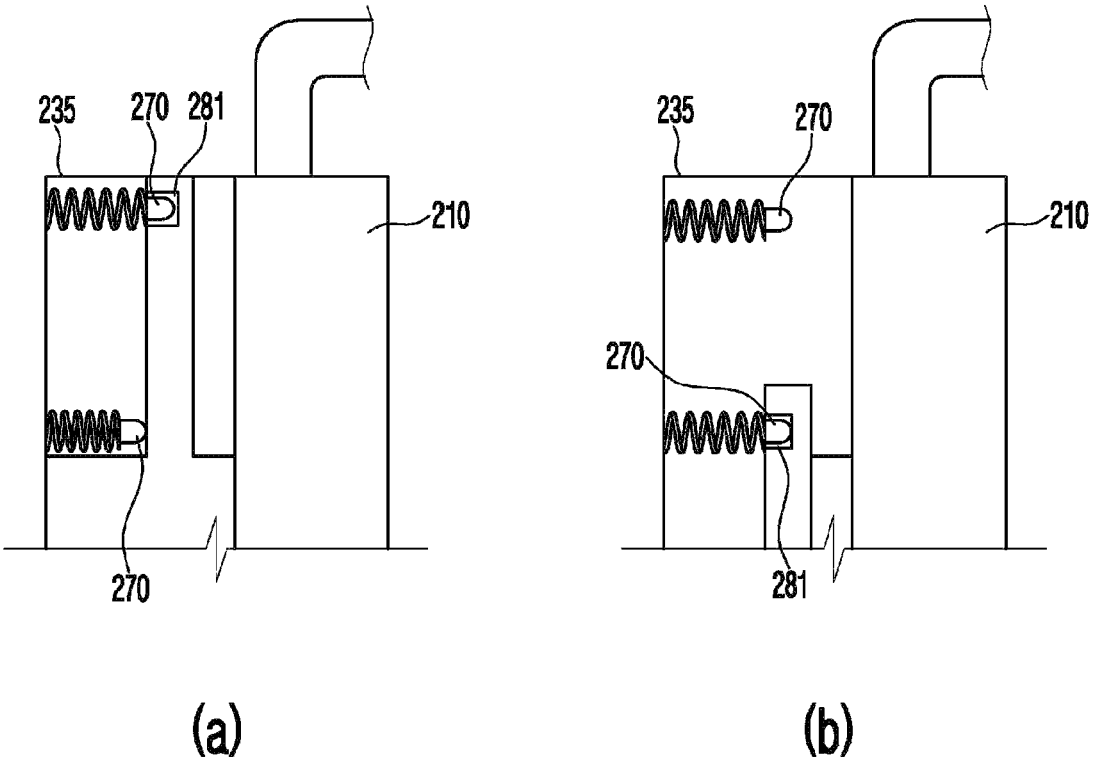
FIGS. 12*a*-12*b* are views for explaining an operation of a coupling part in the embodiment in FIG. 9 or 11.

FIG. 12 is a view for explaining an operation of the coupling part 270 in the embodiment of FIG. 9 or 11. Although a spring is provided at one end of the coupling part 270 for left and right movements of the coupling part 270 in FIG. 12, the embodiment of the present invention is not limited thereto. For example, any structure capable of moving the coupling part 270 in left and right directions is acceptable. Although the coupling part 270 moves by the operation of the coupling control part 265 in FIG. 10, the coupling part 270 may move by the locking control part 150, the control part 250, or an additional control component, which are not shown in the drawing, in FIG. 12. Also, although not shown in FIG. 12, the coupling part 270 may move by the operation of the coupling control part 265 in the same manner as shown in FIG. 10.

According to an embodiment, as illustrated in FIG. 12, the second frame may further include a coupling groove 281 which is defined at one side of the second frame 220 and to which a coupling part 270 is inserted, and the rail part 235 provided in the main body unit may further include a coupling part 270 disposed at each of upper and lower ends of the rail part 235 and capable of being inserted to and separated from the coupling groove 281 of the second frame 220. The coupling part 270 provided at the upper portion of the rail part 235 may be inserted into the coupling groove 281 in case of not forming the support. In case of forming the support, the coupling part 270 provided at the lower end of the rail part 235 may be inserted into the coupling groove 281 as the second frame 220 moves along the rail part 235. FIG. 12A is a view illustrating a case when the second frame 220 is disposed at an original position without moving along the rail part 235, i.e., a case of not forming the support, and FIG. 12B is a view illustrating a case when the second frame 220 moves along the rail part 235, i.e., a case of forming the support.

According to an embodiment, as in the embodiments described above with reference to FIG. 9 or FIG. 11, when the second frame 220 includes auxiliary frame 230 for extension of the second frame 220, the coupling part 270 in FIG. 10 and the coupling groove 281 in FIG. 12 may be formed on the auxiliary frame 230.

As described above, the coupling part 270 in FIG. 12 may be controlled by the locking control part 150, the control part 250, the coupling control part 265, or an additional control component, and as the user operates one of the above-described components, the coupling part 270 may be separated from or inserted to the coupling groove 281.

All of the above-described features according to the embodiments in FIGS. 1 to 6 may be applied to the above-described other embodiments in FIGS. 7 to 12.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Thus, the above-disclosed embodiments are to be considered illustrative and not restrictive.

What is claimed is:

1. A luggage with a support, comprising:

a main body unit having a storage space therein;

a cover unit configured to close the storage space of the main body unit; and a frame unit provided on a rear surface of the main body unit to form a support configured to support the main body unit, wherein the frame unit comprises:

a first frame having one side fixed to a lower portion of the main body unit and the other side that is rotatable; and a second frame configured to move along the rotation of the first frame and form the support with the first frame, wherein the first frame unit is a handle part which comprises:

an outer frame provided at both left and right sides of the rear surface of the main body unit; and an inner frame inserted to an upper end of the outer frame to vertically move, and configured to connect the outer frames, wherein the vertical move of the inner frame is controlled by control part which is provided at the inner frame, and wherein the handle part is configured for pulling the luggage when positioned in a first position and configured to support the luggage when positioned in a second position.

2. The luggage of claim 1, wherein the second frame has one side fixed to an upper portion of the main body unit and the other side rotating along the rotation of the first frame.

3. The luggage of claim 2, wherein the first frame or the second frame further comprises:

a connection part configured to connect the first frame and the second frame; and a guide line configured to guide a movement of the connection part.

4. The luggage of claim 3, wherein the first frame further comprises a fixing part configured to fix positions of the first frame and the second frame, and the second frame further comprises a fixing groove which is provided at a lower end side of the guide line and to which the fixing part is inserted, wherein the fixing part can be inserted to and separated from the fixing groove.

5. The luggage of claim 4, further comprising a control part configured to control the insertion and separation of the fixing part with respect to the fixing groove.

6. The luggage of claim 1, wherein the main body unit further comprises a locking part provided at an upper portion of the main body unit to prevent the frame unit from being separated from the main body unit, and the first frame further comprises a locking groove to which the locking part is inserted, wherein the locking part can be inserted to and separated from the locking groove.

7. The luggage of claim 6, further comprising a locking control part configured to control the insertion and separation of the locking part with respect to the locking groove.

8. The luggage of claim 1, wherein the cover unit comprises a first cover and a second cover, which are opened in opposite directions to each other, wherein each of the first cover and the second cover has a rectangular parallelepiped shape in which one side surface facing the main body unit is open.

9. The luggage of claim 8, wherein each of the first cover and the second cover has a detachable surface at which the first cover and the second cover contact each other.

10. The luggage of claim 1, wherein the second frame further comprises an auxiliary frame provided at one side of the second frame to extend the second frame.

11. The luggage of claim 10, wherein the auxiliary frame is connected to one end of the second frame through a hinge, and moves along a rail provided on the rear surface of the main body unit.

12. The luggage of claim 10, wherein the auxiliary frame is inserted into the second frame in a movable manner.

13. The luggage of claim 1, wherein the second frame has one side that is movable along a rail part provided at an upper portion of the main body unit.

14. The luggage of claim 13, wherein the second frame further comprises a coupling part disposed at one side thereof, and inserted to and separated from the main body unit, and the main body unit further comprises a coupling groove which is disposed at each of upper and lower ends of the rail part and to which the coupling part is inserted.

15. The luggage of claim 1, wherein the main body unit further comprises a frame accommodation groove defined at the rear surface of the main body unit to accommodate the frame unit.

* * * * *